US006908400B2

(12) United States Patent
Chu et al.

(10) Patent No.: US 6,908,400 B2
(45) Date of Patent: Jun. 21, 2005

(54) GOLF CLUB GRIP WITH A HEM STRUCTURE

(75) Inventors: Hong-Sung Chu, No. 697, Sec. 5, Chung-Shan N. Rd., Taipei City (TW); Chia-Hung Wu, Taichung (TW)

(73) Assignee: Hong-Sung Chu, Taipei (TW)

( * ) Notice: Subject to any disclaimer, the term of this patent is extended or adjusted under 35 U.S.C. 154(b) by 0 days.

(21) Appl. No.: 10/634,387

(22) Filed: Aug. 5, 2003

(65) Prior Publication Data

US 2004/0029646 A1 Feb. 12, 2004

(30) Foreign Application Priority Data

Aug. 7, 2002 (TW) ..... 91212176 U

(51) Int. Cl.[7] ..... A63B 53/14
(52) U.S. Cl. ..... 473/303
(58) Field of Search ..... 473/300–303, 473/549, 568; 74/551.9; 81/489, 492; 16/421; 280/821

(56) References Cited

U.S. PATENT DOCUMENTS 3,311,375 A * 3/1967 Onions ..... 473/301
2003/0228930 A1 * 12/2003 Huang ..... 473/301

* cited by examiner

*Primary Examiner*—Stephen Blau
(74) *Attorney, Agent, or Firm*—Pitney Hardin LLP

(57) ABSTRACT

A golf club grip includes a sleeve body having a top cap and a bottom protective rim, and an anti-slip sheet layer extending around the sleeve body between the cap and the protective rim. The sheet layer has a top circumferential margin which is hidden and hemmed by the cap. The sheet layer further includes two axial margin which extend near to each other and which are hemmed by an axial hem structure of the sleeve body. The axial hem structure extends from the cap to the protective rim to receive and hem the axial margins. As the margins of the sheet layer are hemmed and finished by the cap, the protective rim and the axial hem structure, no visible clearance is formed in the golf club grip.

13 Claims, 8 Drawing Sheets

GOLF CLUB GRIP WITH A HEM STRUCTURE

CROSS-REFERENCE TO RELATED APPLICATION

This application claims priority of Taiwanese (patent) Application No. 091212176, filed on Aug. 7, 2002.

BACKGROUND OF THE INVENTION

1. Field of the Invention

The invention relates to a golf club grip, more particularly to a golf club grip having a hem structure for finishing and hemming the marginal edges of a winding sheet layer.

2. Description of the Related Art

Referring to FIGS. 1 and 2, a conventional golf club grip 1 includes a fabric lining 11 adhered by means of a natural fixative 10 to a golf club shaft 14, a longitudinal leather strip 12 spirally wrapped around the lining 11, and two coiled wires 13 respectively fastening top and bottom ends of the strip 12 to the golf club shaft 14.

FIG. 3 shows a conventional golf club grip 2 disclosed in U.S. Pat. No. 6,386,989, which includes a winding strip 20 made of a synthetic leather, such as polyurethane, and an inner sleeve 21. The strip 20 is spirally wound around the inner sleeve 21 and is adhered thereto through a double-sided adhesive tape 22 which is attached to the inner surface of the strip 20. The two ends of the strip 20 are respectively secured to a lip 240 of a threaded head 24 provided at the lower end of the inner sleeve 21 and to the lower end of a cover 23 provided on top of the golf club shaft 14.

In order to reinforce the connection between the strip 12 and the golf club shaft 14 and the connection between the strip 20 and the inner sleeve 21, the natural fixative 10 and the double-sided adhesive tape 22 are respectively used in the above conventional golf club grips 1 and 2 to provide an adhesive effect. However, the strip 12 or 20 is easily unravelled from the golf club shaft 14 or the inner sleeve 21 after a period of use due to insufficient adhesiveness of the glue 10 or the double-sided adhesive tape 22. While the strip 12 or 20 spirally wound around the golf club shaft 14 or the inner sleeve 21 can improve the securing of the strip 12 or 20 to the golf club shaft 14 or the inner sleeve 21, the grip 1 or 2 suffers from the following drawbacks:

1. The operation of winding the strip 12 or 20 is difficult and requires a certain level of skill. Careful attention must be paid for conducting the winding operation. Otherwise, the strips 12, 20 can become loosened and clearances can be formed between adjacent turns of the strip 12 or 20.

2. Since the strip 12 or 20 is wound spirally, it can not provide a grip surface which is as smooth as that formed by a single-turn winding sheet wrapped around a golf club shaft. The grip surface resulting from the spirally winding strip 12 or 20 is unable to provide a good feel of comfort.

In view of the aforesaid drawbacks, the inventor of this application has developed a sleeve-on type grip 3, as shown in FIG. 6. The grip 3 is formed as a multi-layered structure which includes a base layer 30 made of a close-cell foam and an anti-slip face layer 31 attached to the base layer 30. The anti-slip face layer 31 is bonded to the base layer 30 by using a high adhesion strength cement 32 (such as a polychloroprene resin, an adhesive alloy, etc.). The base layer 30 is a molded tubular lining sleeve, whereas the anti-slip face layer 31 is formed by tailoring a sheeting material.

The grip 3 formed as such can alleviate the problems encountered by the conventional grips 1 and 2. However, as the base layer 30 is molded into a tubular lining sleeve and as the shrinkage of the lining sleeve of the base layer 30 varies due to the change in temperature, material, and other parameters of the processing steps, such as forming, mold releasing, drying, etc., the dimension of the base layer 30 tends to deviate from the predetermined dimension thereof. Such a dimensional deviation can produce a clearance between the top end of the anti-slip face layer 31 and a cap 33 formed on top of the base layer 30. This affects adversely the appearance and quality of the golf club grip 3.

In addition, although the face layer 31 can be bonded effectively to the base layer 30 because of the use of the high adhesion strength cement, e.g. a polychloroprene resin, the cement, after being hardened, tends to reduce the extensibility of the grip 3. Owing to the insufficient extensibility of the grip 3, when a golf club shaft 4 is inserted into the grip 3, the grip 3 tends to burst at its axial seam 35 due to the insertion of the golf club shaft 4 which forces the grip 3 to expand. Moreover, it is difficult to sleeve the grip 3 over the golf club shaft 4 because of the insufficient extensibility of the grip 3.

SUMMARY OF THE INVENTION

An object of the present invention is to provide a golf club grip including an anti-slip sheet layer which has margins hemmed and finished to prevent formation of visible clearance, thereby alleviating the problem of defective products due to the clearances formed at the marginal edges thereof.

Another object of the present invention is to provide a golf club grip with a simple construction for hemming and finishing an anti-slip sheet layer.

Still another object of the present invention is to provide a golf club grip which is not only easy to be sleeved over a golf club shaft but also is sufficiently expandable to eliminate of the problem that the grip tends to burst at its seam when being sleeved over the golf club shaft.

According to one aspect of the present invention, a golf club grip comprises: a lining sleeve which includes a sleeve body having top and bottom ends, a cap projecting radially from the top end, and a protective rim projecting radially from the bottom end, the cap being formed with an annular recess; an anti-slip sheet layer extending around the lining sleeve between the cap and the protective rim, the sheet layer having top and bottom circumferential margins, the top circumferential margin being fitted within the annular recess so as to be hemmed and hidden by a portion of the cap, the bottom circumferential margin being in abutment with the protective rim.

According to another aspect of the present invention, a golf club grip comprises: a lining sleeve which includes a sleeve body having top and bottom ends, a cap projecting radially from the top end, and a protective rim projecting radially from the bottom end; an anti-slip sheet layer extending around the lining sleeve between the cap and the protective rim, the sheet layer having top and bottom circumferential margins respectively proximate to the cap and the protective rim, and two axial margins which interconnect said top and bottom circumferential margins and which extend adjacent to each other; and a hem structure extending axially from the cap to the protective rim along the axial margins, wherein the axial margins of the sheet layer are received in and finished by the hem structure.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
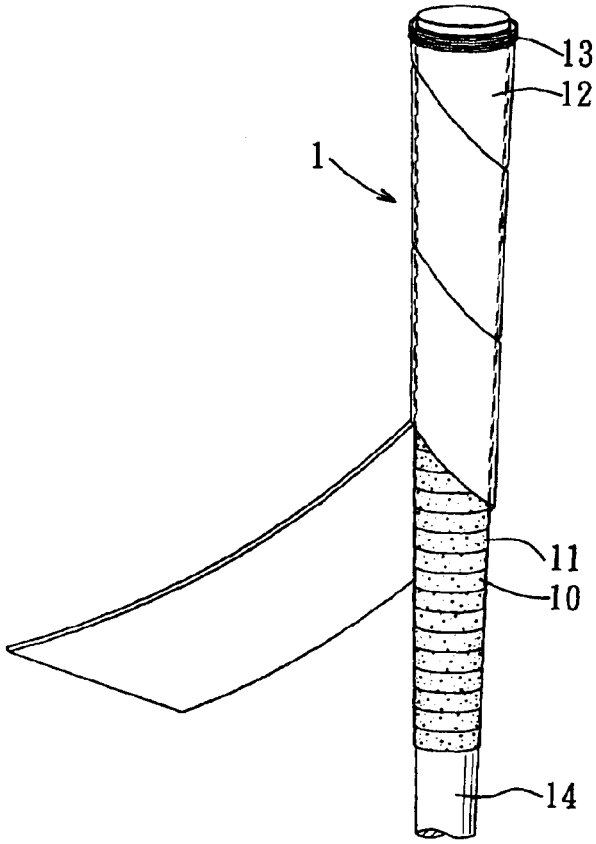
FIG. 1 PRIOR ART
FIG. 1 is a perspective view of a conventional golf club grip.
Figure 2:
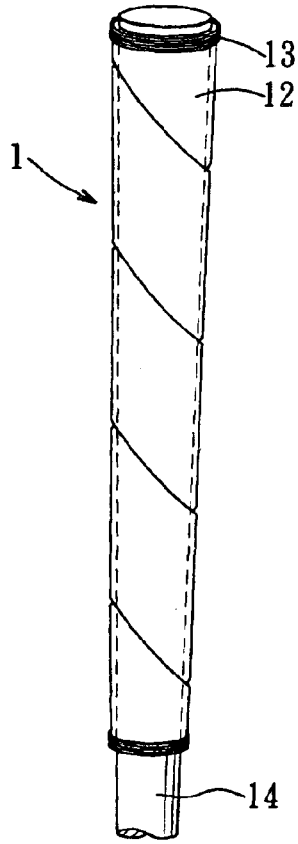
FIG. 2 PRIOR ART
FIG. 2 is another perspective view of the conventional golf club grip of FIG. 1.
Figure 3:
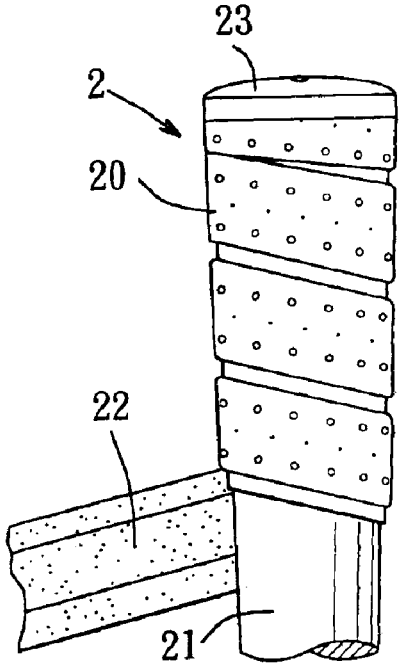
FIG. 3 PRIOR ART
FIG. 3 is a perspective view of another conventional golf club grip.
Figure 5:
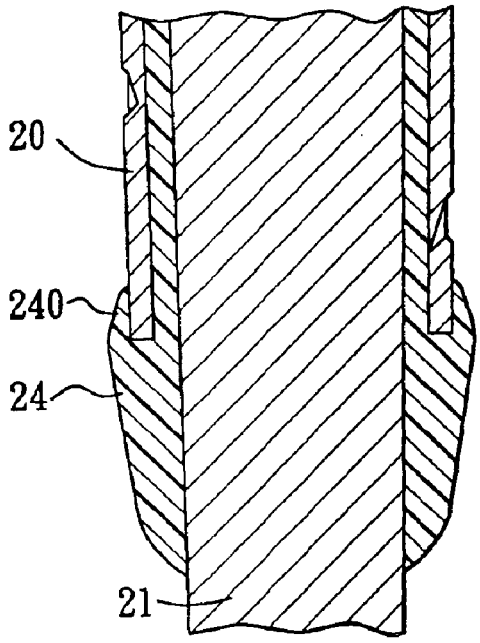
FIG. 5 PRIOR ART
FIG. 5 is a fragmentary sectional view of the golf club grip of FIG. 3.
Figure 4:
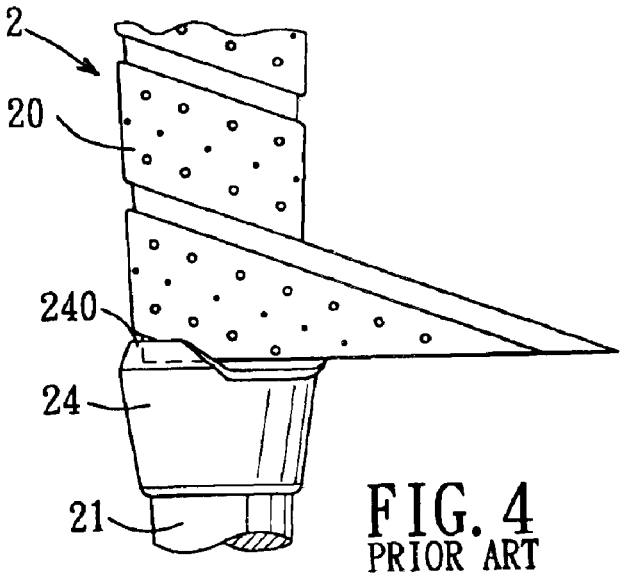
FIG. 4 PRIOR ART
FIG. 4 is a fragmentary perspective view of the golf club grip of FIG. 3.
Figure 6:
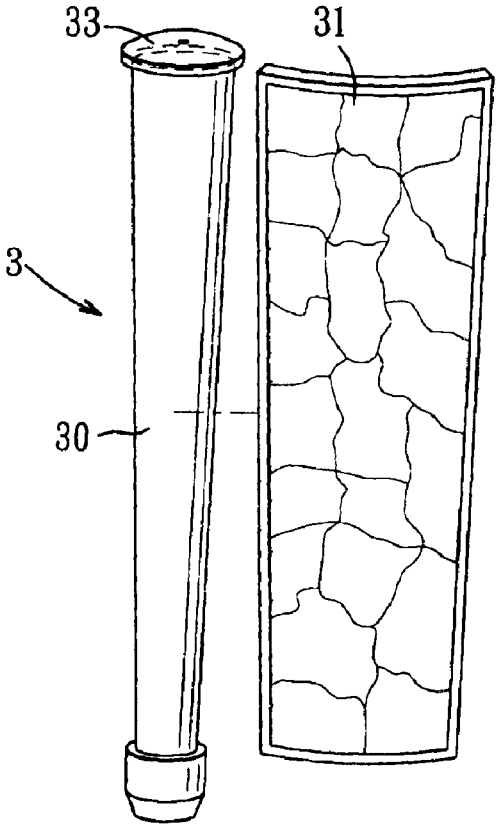
FIG. 6 PRIOR ART
FIG. 6 is an exploded view of still another conventional golf club grip.
Figure 7:
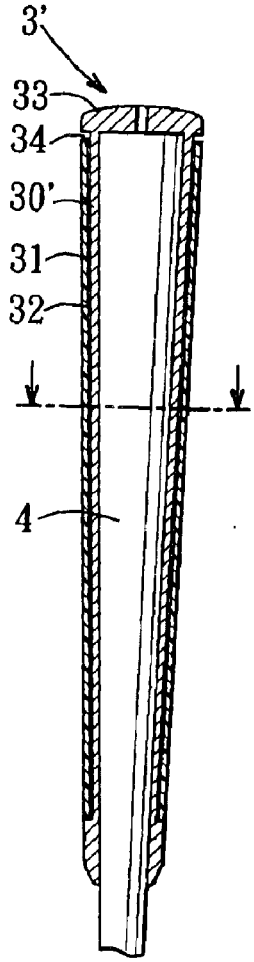
FIG. 7 PRIOR ART
FIG. 7 is a sectional view of the golf club grip of FIG. 6.
Figure 8:
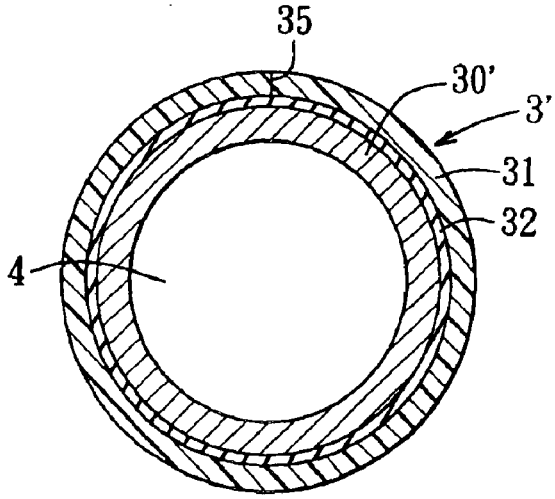
FIG. 8 PRIOR ART
FIG. 8 is another sectional view of the golf club grip of FIG. 6.

The present invention will be illustrated with reference to FIGS. 9 to 19, wherein like elements are represented by like reference numerals.

Figure 9:
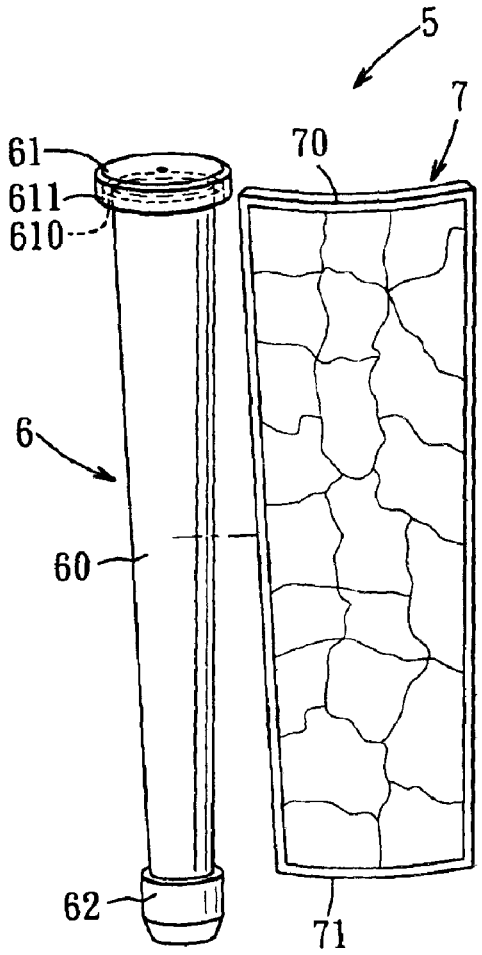
FIG. 9 is an exploded view of a first embodiment of a golf club grip according to the present invention.
Figure 10:
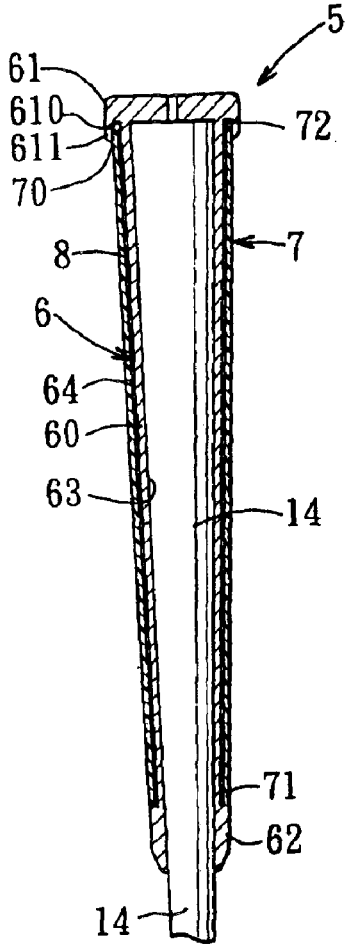
FIG. 10 is a sectional view of the first embodiment.

Referring to FIGS. 9 and 10, a first embodiment of the present invention includes a golf club grip 5 mountable on one end of a golf club shaft 14. The golf club grip 5 includes an inner lining sleeve 6 and an anti-slip sheet layer 7 made of a sheeting material.

The inner lining sleeve 6 has an inner surface 63 surrounding the golf club shaft 14 and is made of a resilient polymeric material such as a rubber, a rubber compound, a thermoplastic elastomer (TPE), a thermoplastic rubber (TPR), or any suitable plastic, or a close-celled foam of a plastic or rubber. The lining sleeve material is formed into a hollow tubular body through a molding process. In particular, the lining sleeve 6 includes a sleeve body 60 with top and bottom ends respectively provided with a cap 61 and a protective rim 62. The cap 61 is annular, and projects radially from the top end of the sleeve body 60, and has a first skirt part 611 projecting downward from a peripheral end of the cap 61 and confining an annular recess 610 around the sleeve body 60.

The anti-slip sheet layer 7 is made of a sheeting material which may be natural leather, a synthetic leather, a PU leather, a fabric or a fibrous material and is formed by tailoring the sheeting material. The anti-slip sheet layer 7 is bonded to the outer surface 64 of the inner lining sleeve 6 through a bonding layer 8 including a high adhesion strength cement such as that made from a polychloroprene polymer.

In assembly, a bottom circumferential margin 71 of the anti-slip sheet layer 7 abuts against the protective rim 62, whereas a top circumferential margin 70 thereof is received within the annular recess 610 of the cap 61. The cap 61 and the protective rim 62 serve to hem and finish top and bottom circumferential margins 70 and 71 of the sheet layer 7. In case the axial dimension of the lining sleeve 6 deviates from its predetermined dimension so that the axial dimension of the sheet layer 7 is shorter than the distance between the cap 61 and the protective rim 62, there may be a clearance 72 between the top margin 70 of the anti-slip sheet layer 7 and the cap 61 when the sheet layer 7 is assembled around the sleeve body 60. In this situation, even if the width of the clearance 72 is up to 2 mm, the clearance 72 can be covered and hidden by the first skirt part 611 of the cap 61 so that no clearance can be seen in the grip 5. Therefore, the clearance problem that leads to defects in the appearance of the golf club grip 5 as encountered in the prior art is alleviated. The hemming and finishing of the top and bottom circumferential margins 70 and 71 of the anti-slip sheet layer 7 as such is easy to accomplish. This increases the rate of production of good quality products and reduces the amount of defective products, thereby lowering the cost of production.

Figure 11:
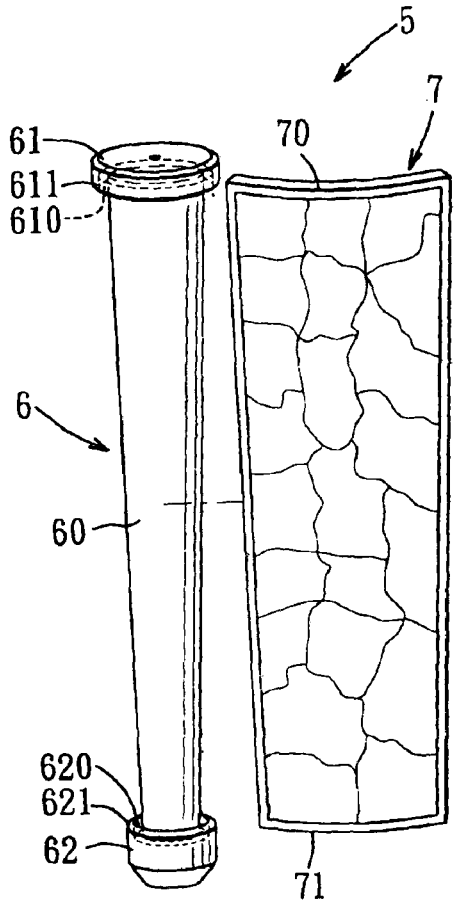
FIG. 11 is an exploded view of a second embodiment of a golf club grip according to the present invention.
Figure 12:
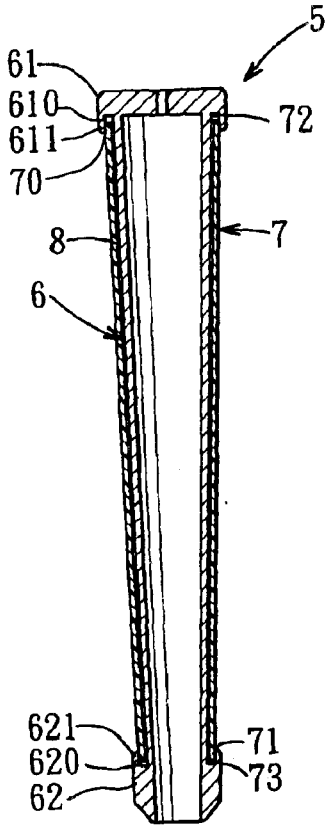
FIG. 12 is a sectional view of the second embodiment.

Referring to FIGS. 11 and 12, the second embodiment of the present invention is substantially similar to the first embodiment except that the protective rim 62 of the sleeve body 60 is provided with a second skirt part 621 which projects axially toward the cap 61 from the outer periphery of the protectively rim 62, and a second annular recess 620 confined by the second skirt 621 and the outer surface of the sleeve body 60. As compared with the first embodiment, the construction of the second embodiment permits more dimensional tolerance for manufacturing the lining sleeve 6. If the axial dimension of the sleeve body 60 deviates from its standard dimension by more than 2 mm, the axial dimension of the sheet layer 7 would be more than 2 mm shorter than the distance between the cap 61 and the protective rim 62. By arranging the top and bottom circumferential margins 70 and 71 of the sheet layer 7 to be spaced respectively from the cap 61 and the protective rim 62 with a clearance which ranges up to 2–3 mm, the clearance may be hidden and the top and bottom circumferential margins 70, 71 may be hemmed and finished by the first and second skirt parts 611 and 621.

Figure 13:
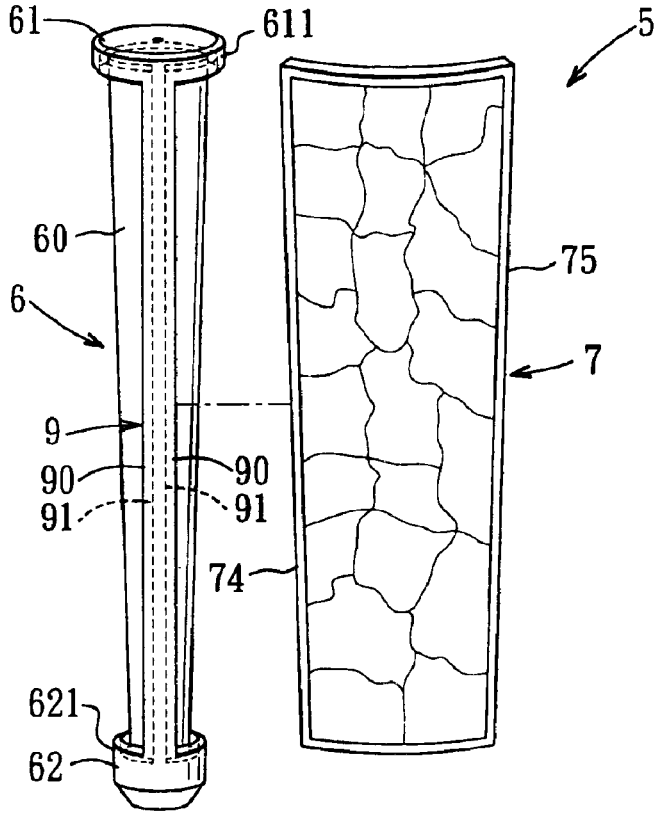
FIG. 13 is an exploded view of a third embodiment of a golf club grip according to the present invention.

Referring to FIG. 13, a third embodiment of the present invention is substantially similar to the second embodiment except that the sleeve body 60 is provided an axial hem structure 9 extending from the cap 61 to the protective rim 62. Together with the outer surface of the sleeve body 60, the hem structure 9 confines an axial receiving space (which is detailed hereinafter) to receive two axial margins 74, 75 of the anti-slip sheet layer 7, which are placed near to each other. Preferably, the axial hem structure 9 is connected between and is molded integrally with the cap 61 and the protective rim 62.

Figure 14:
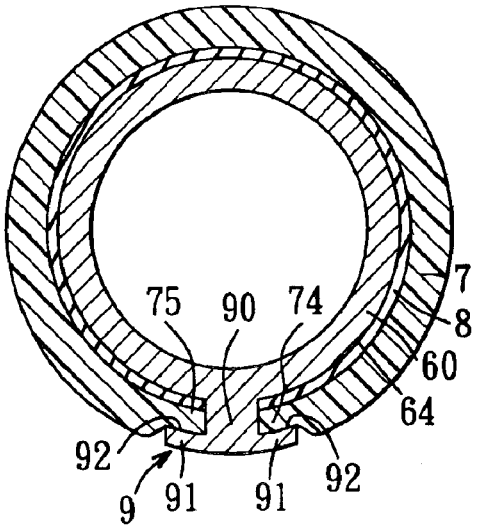
FIG. 14 is a sectional view of the third embodiment.

In particular, as shown in FIG. 14, the hem structure 9 includes an axial rib 90 which has a substantially T-shaped cross-section and which projects radially from the outer surface of the sleeve body 60 and extends axially from the cap 61 to the protective rim 62. A pair of flanges 91 project from the distal end of the axial rib 90 in opposite circumferential directions and are respectively connected to the first and second skirt parts 611 and 621. The axial receiving space of the hem structure 9 is composed of two axial cavities 92 respectively defined at two sides of the axial rib 90 by the flanges 91. In assembly, the axial margins 74, 75 of the anti-slip sheet layer 7 are inserted respectively into the axial cavities 92 so that the axial margins 74, 75 are hidden and hemmed respectively by the flanges 91. Preferably, the thickness of the axial margins 74, 75 is reduced so as to be smaller than that of the remaining part of the anti-slip sheet layer 7. This can be done by hot-pressing, embossing or stitching the axial margins 74, 75 of the sheet layer 7. As the thickness of the axial margins 74, 75 is small, insertion of the axial margins 74, 75 into the cavities 92 can be facilitated. Furthermore, since the axial margins 74, 75 are thinner than the remaining part of the sheet layer 7, the joining of the sheet layer 7 with the flanges 91 can be smooth and neat. In addition, since the hem structure 9 is integrally molded with the sleeve body 60, the extension characteristic of the hem structure 9 is the same as that of the sleeve body 60. Therefore, when the grip 5 is sleeved onto the golf club shaft 14 and when the grip 5 is forced to expand by the body of the golf club shaft 14, the hem structure 9 can effectively receive the axial margins 74, 75 so that no clearance will be exposed from the hem structure 9. Furthermore, the grip 5 is easy to assemble.

Figure 15:
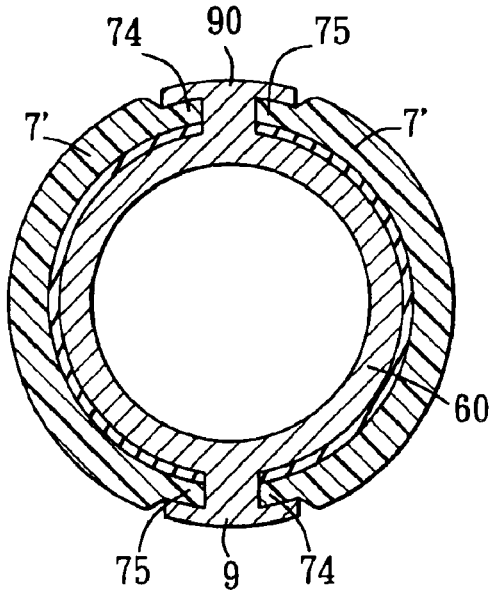
FIG. 15 is a sectional view of a fourth embodiment of a golf club grip according to the present invention.

The sleeve body 60 in the present invention is not limited only to one single hem structure 9. Referring to FIG. 15, in the fourth embodiment of the present invention, the sleeve body 60 is provided with two hem structures 9 which are diametrically opposed. In this embodiment, two anti-slip sheet layers 7' are provided around the sleeve body 60. Each sheet layer 7' extends between the two hem structures 9 and has two axial margins 74, 75 respectively received and hemmed by the two hem structures 9. The total area of the two sheet layers 7' is substantially similar to the area of the single sheet layer 7 of the third embodiment.

Figure 16:
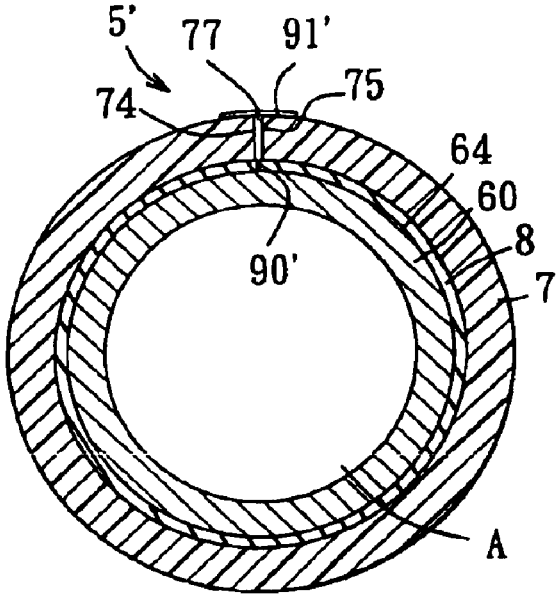
FIG. 16 is a sectional view of a fifth embodiment.
Figure 17:
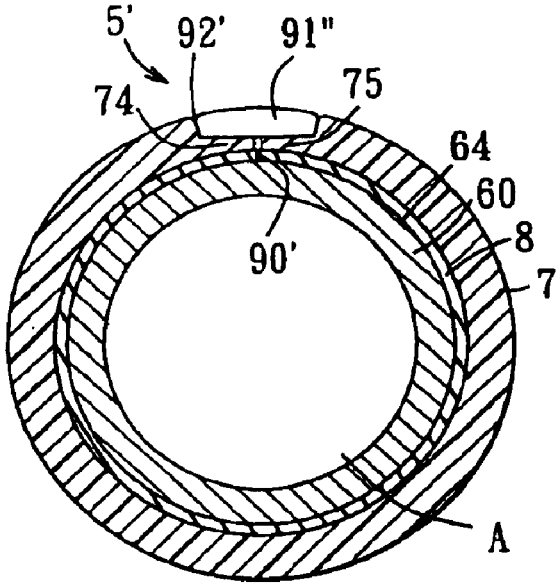
FIG. 17 is a sectional view of a sixth embodiment.

In order to achieve an effect of easy hemming and finishing the margins 74, 75 of the sheet layer 7, the present invention may also utilize the constructions of fifth and sixth preferred embodiments as shown in FIGS. 16 and 17, in addition to the third and fourth embodiments. The fifth and sixth embodiments are provided based on the constructions of the first and second embodiments. However, the material of the sheet layer 7 is limited to a PU synthetic leather, and the thickness thereof is preferably about 1.2 mm–1.8 mm.

Referring to FIGS. 16 and 17, grips 5' are provided respectively in the fifth and sixth preferred embodiments of the present invention. Each grip 5' includes a hem structure which includes a seam straightening rib 90' extending axially from a cap 61 and a protective rim 62 and projecting radially and slightly from the outer surface 64 of the sleeve body 60.

Figure 18:
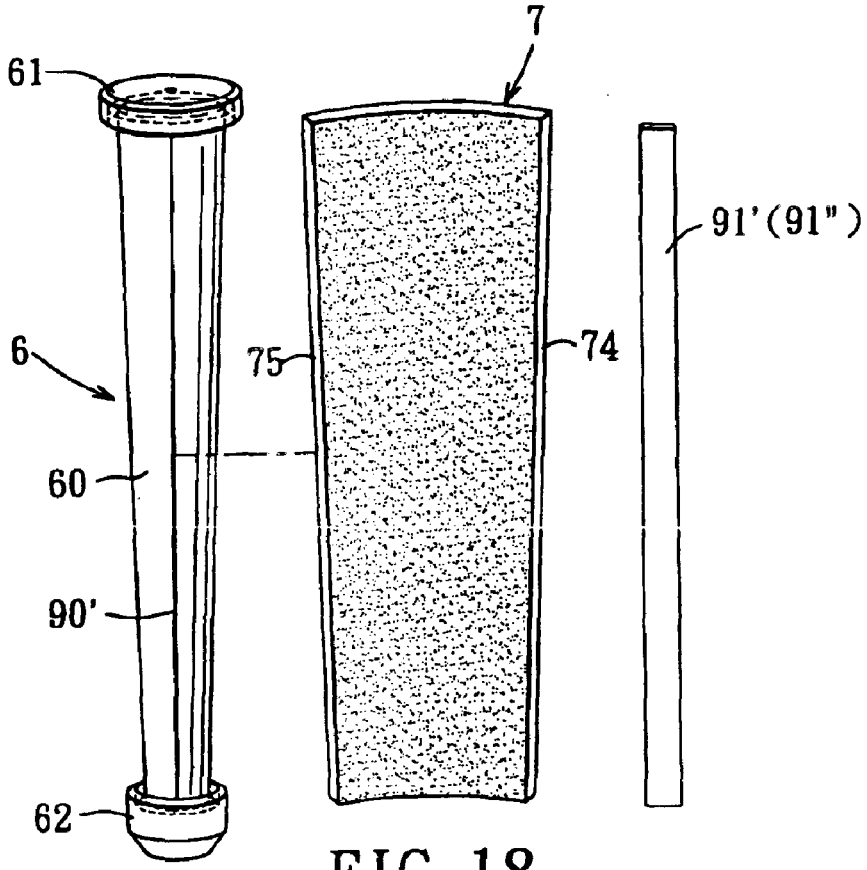
FIG. 18 is an exploded view of the fifth or sixth embodiment.

As shown in FIG. 18, the seam straightening rib 90' is located between the cap 61 and the protective rim 62 so that the two axial margins 74, 75 meet each other along a straight line defined by the seam straightening rib 90'. An axial seam 77 is thus defined by the axial margins 74, 75. A hemming strip 91' in the fifth embodiment is bonded onto the outer surface of the sheet layer 7 along the seam 77 to finish the seam 77. Or, a hemming strip 91" in the sixth embodiment is inset bonded within the hem receiving groove 92" to finish the seam 77 (which is detailed hereinafter).

Referring to FIG. 16, the hemming strip 91' in the fifth embodiment may be prepared and assembled on the sheet layer 7 through high frequency heat cutting, hot pressing and bonding processes. In particular, a TPU or PVC sheet which is 0.15 mm–0.3 mm thick is first coated at its back side with a cement and then placed over the seam 77 and the axial margins 74, 75 of the sheet layer 7. Then, a high frequency die which is substantially U-shaped in cross section and which has axial dimensions conforming to the axial dimensions of the grip 5' at the seam 77 is used to heat cut and hot press the TPU or PVC sheet at an instantaneous heating temperature of about 150° C. The temperature varies depending upon the sheet material and the operating machine. The hemming strip 91' with a width of about 4 mm is therefore formed. The hemming strip 91' is then bonded onto the outer surface of the sheet layer 7 along the seam 77 through a bonding process.

Figure 19:
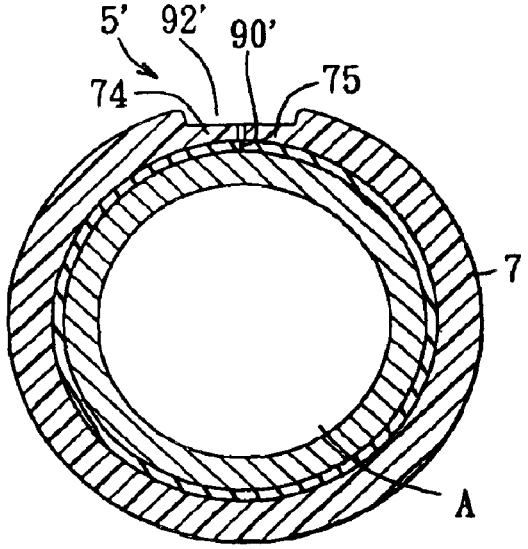
FIG. 19 illustrates the fabrication of the sixth embodiment.

Referring to FIG. 17, the hemming strip 91" in the sixth embodiment may be prepared and bonded to the anti-slip sheet layer 7 through a hot pressing process followed by an inset bonding process. First, the two axial margins 74, 75 of the sheet layer 7 are hot pressed to form the L-shaped corners. Then, the axial margins 74, 75 are aligned along a straight line defined the seam straightening rib 90'. The hem receiving groove 92' is therefore formed along and above the seam straightening rib 90', as shown in FIG. 19. The hemming strip 91" is prepared from a sheet material with a back side thereof coated with the cement. The sheet material is hot pressed and heat cut instantaneously through a high frequency die to form a strip which has an axial length similar to the distance between the cap 61 and the protective rim 62 and which has a thickness of about 0.15–0.4 mm and a width of about 4 mm. The sheet material may be TPU, PVC or PU leather. A PU leather which is about 0.4 mm thick is preferred.

The hemming strip 91", which has been coated with the cement as mentioned above, is placed over the hem receiving groove 92'. Then, a high frequency die with a heated die, which is substantially U-shaped in cross section and which has axial dimensions conforming to the axial dimensions of the grip 5' at the seam 77, is used to inset bond the hemming strip 91" within the hem receiving groove 92'.

In order to facilitate the hot pressing operations performed in assembling the hemming strip 91' or 91", the sleeve body 60 of the grip 5' is sleeved over a rod body (A) which provides a supporting force to the sleeve body 60. When the grip 5' is sleeved over a golf club shaft, the grip 5' will be forced to expand by the golf club shaft. Although the bonding force of the bonding layer 8 is the weakest at the seam 77, the incidence of bursting the seam 77 can be prevented by the hemming strip 91' or 91". By fabricating the hemming strip 91' or 91" with a stretchable material such as PVC, TPU, or PU leather to increase the stretchyness of the seam 77 and by overlying the hemming strip 91' or 91" on the seam 77, the grip 5' will not burst at the seam 77. A smooth surface can be maintained at the surface of the seam 77.

Furthermore, as the hemming strip 91' of the fifth embodiment is merely 0.15 mm–0.3 mm thick and is subjected to a high frequency heat sealing treatment, the presence of the hemming strip 91' will not cause the outer appearance of the grip 5' to change from the traditional form or shape of a golf club grip. In the sixth embodiment, because the hemming strip 91" is received in the hem receiving groove 92', the grip 5' can maintain the traditional shape or form of a golf club grip.

In conclusion, the present invention alleviates the clearance problem encountered by the sheet layer 7 due to the manufacturing tolerance of the lining sleeve 6. Since the margins 70, 71, 74 and 75 of the sheet layer 7 are hemmed and finished, no visible clearance is present in the grips 5 and 5'. Accordingly, the rate of the production of the grips 5, 5' is therefore increased and the production cost thereof is reduced. Furthermore, it is easy to hem and finish the sheet layer 7 by finishing or hiding the margins 70, 71, 74 and 75 thereof with the cap 61, the protective rim, and the hem structure 9 or the hemming strips 91', 91".

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

We claim:

1. A golf club grip, comprising:

a lining sleeve which includes a sleeve body having top and bottom ends, a cap projecting radially from said top end, and a protective rim projecting radially from said bottom end, said cap being formed with an annular recess; and an anti-slip sheet layer extending around said lining sleeve between said cap and said protective rim, said sheet layer having top and bottom circumferential margins, said top circumferential margin being fitted within said annular recess so as to be hemmed and hidden by a portion of said cap, said bottom circumferential margin being in abutment with said protective rim, wherein said cap includes a first skirt part which projects axially toward said protective rim from a distal end of said cap and which confines said annular recess, said first skirt part forming said portion of said cap, wherein said anti-slip sheet layer further includes two axial margins which interconnect said top and bottom circumferential margins and which are near to each other, and wherein said grip further includes an axial hem structure which extends from said cap to said protective rim along said axial margins of said sheet layer, said axial margins of said sheet layer being received by said hem structure so as to be hidden by said hem structure.

2. The golf club grip as claimed in claim 1, wherein said hem structure is molded integrally with said cap and said protective rim.

3. The golf club grip as claimed in claim 1, wherein said hem structure includes an axial rib extending radially from an outer surface of said sleeve body from said cap to said protective rim, and a pair of flanges which project from an outer distal end of said axial rib substantially in opposite circumferential directions, said flanges respectively defining two cavities on two sides of said axial rib to receive respectively said axial margins of said sheet layer.

4. The golf club grip as claimed in claim 1, wherein said axial margins of said sheet layer define a seam therebetween, said hem structure comprising a seam straightening rib projecting from said sleeve body and extending axially from said cap to said protective rim so as to straighten said seam, and a hemming strip overlying said seam and bonded onto said axial margins, said seam being aligned with said seam straightening rib.

5. The golf club grip as claimed in claim 4, further comprising a hem receiving groove formed in said sheet layer along and above said seam straightening rib to receive said hemming strip.

6. The golf club grip as claimed in claim 1, wherein said lining sleeve is a molded tubular body.

7. The golf club grip as claimed in claim 6, wherein said tubular body is made of a resilient polymeric material which is selected from a group consisting of rubbers, rubber compounds, thermoplastic elastomer (TPE), thermoplastic rubber (TPR), elastomers, and close-celled foams of plastics and rubbers.

8. A golf club grip, comprising:

a lining sleeve which includes a sleeve body having top and bottom ends, a cap projecting radially from said top end, and a protective rim projecting radially from said bottom end;

an anti-slip sheet layer extending around said lining sleeve between said cap and said protective rim, said sheet layer having top and bottom circumferential margins respectively proximate to said cap and said protective rim, two axial margins which interconnect said top and bottom circumferential margins and which extend near to each other, and a hem structure extending axially from said cap to said protective rim along said axial margins, wherein said axial margins of said sheet layer are received in and finished by said hem structure.

9. The golf club grip as claimed in claim 8, wherein said hem structure is molded integrally with said cap and said protective rim.

10. The golf club grip as claimed in claim 9, wherein said hem structure includes an axial rib extending radially from an outer surface of said sleeve body between said cap and said protective rim and along said axial margins, and a pair of flanges which project from an outer distal end of said rib substantially in opposite circumferential directions, said flanges defining respectively two cavities on two sides of said axial rib to receive respectively said axial margins.

11. The golf club grip as claimed in claim 10, wherein said cap includes a first skirt part which projects axially toward said protective rim from a distal end of said cap and which confines an annular recess around said sleeve body, said protective rim including a second skirt part which projects axially toward said cap from a distal end of said protective rim and which confines an additional annular recess, said flanges being connected to said first and second skirt parts.

12. The golf club grip as claimed in claim 8, wherein said axial margins of said sheet layer define a seam therebetween, said hem structure comprising a seam straightening rib projecting from said sleeve body and extending axially from said cap to said protective rim said seam so as to straighten said seam, and a hemming strip overlying said seam and bonded onto said axial margins, said seam being aligned with said seam straightening rib.

13. The golf club grip as claimed in claim 12, further comprising a hem receiving groove formed in said sheet layer along and above said seam straightening rib to receive said hemming strip.

* * * * *